United States Patent [19]

Tea et al.

[11] 4,098,180

[45] Jul. 4, 1978

[54] APPARATUS FOR BALING BAGASSE AND THE LIKE

[75] Inventors: Frank C. Tea; Philip S. Hartman, both of Bellevue, Ohio

[73] Assignee: The American Baler Company, Bellevue, Ohio

[21] Appl. No.: 741,967

[22] Filed: Nov. 15, 1976

[51] Int. Cl.[2] ..... B30B 15/06

[52] U.S. Cl. ..... 100/98 A; 100/192; 100/295

[58] Field of Search ..... 100/49, 192, 3, 295, 100/179, 98 A, 43; 425/414, 467, 466, 468, 262, 462, 376 R, 380, 381

[56] References Cited

U.S. PATENT DOCUMENTS

| | | | |
|---|---|---|---|
| 2,737,108 | 3/1956 | Galick | 100/98 A |
| 2,746,781 | 5/1956 | Jones | 271/152 |
| 2,770,841 | 11/1956 | Cooke | 100/DIG. 3 |
| 2,953,834 | 9/1960 | Muttart | 100/98 A UX |
| 3,022,723 | 2/1962 | Templeton | 100/98 A |
| 3,230,902 | 1/1966 | Grimm | 100/DIG. 3 |
| 3,249,040 | 5/1966 | Lely | 100/245 X |
| 3,772,983 | 11/1973 | Nichols | 100/295 X |

*Primary Examiner*—Billy J. Wilhite

*Attorney, Agent, or Firm*—Bosworth, Sessions & McCoy

[57] ABSTRACT

There is disclosed a baling apparatus particularly suitable for baling bagasse and similar materials. The apparatus includes a baling chamber formed by a frame having a floor and enclosing sides. A baling head within the chamber is reciprocal between a retracted position and an advanced position, and a ram means connected to the baling head reciprocates the head between its advanced and retracted positions. A support member is mounted on the frame behind the retracted position of the baling head. Anchored at one end in the support member is a mandrel having its other end extending through clearance in the baling head and extending into the baling chamber. The apparatus produces bales having a longitudinally extending opening which tends to prevent the decomposition and decay of the baled material, such as bagasse.

1 Claim, 6 Drawing Figures

APPARATUS FOR BALING BAGASSE AND THE LIKE

BACKGROUND OF THE INVENTION

1. Field of the Invention

This invention relates to apparatus for automatically compressing material into bales, and is particularly suitable for baling material such as bagasse or other similar organic and agricultural by-products.

2. Description of the Prior Art

In the production of sugar, sugar cane is crushed and sugar juice is extracted, leaving a fiberous by-product material called bagasse. The bagasse by-product material is often used for fuel or feed, made into fiberboard, or used in the manufacture of insulation. It is convenient to compress this bagasse into bales for storage and transporting.

Typical prior art extrusion-type baling machines are shown in U.S. Pat. No. 3,024,719 and 3,179,040. These baling machines are designed primarily to bale paper pulp, shreaded paper, waste fibers, or cardboard stock, and are installed in and around industrial operations, such as paper and printing plants. The basic apparatus, however, may also be suitable for baling other materials, but it has been found that the moist organic bagasse fibers are subject to deterioration and rotting when formed in large bales such as those made by these typical prior art baling machines. In particular, the center of the bale, where the organic bagasse is without ventilation, is particularly susceptable to decomposition, decay and rotting.

The inventors are aware of no practical method, other than the method practiced by their invention, of preventing the decomposition, decay and rotting of baled bagasse and they are aware of no other apparatus for forming a bale with a ventilating passage than that comprehended by their invention.

SUMMARY OF THE INVENTION

It is an object of the present invention to provide a baling apparatus, particularly suitable for baling bagasse and similar organic material, in a manner which tends to prevent the rotting and deterioration of the bagasse-like material due to insufficient exposure to air. It is another object to provide an apparatus for baling bagasse and the like which forms a longitudinal hole through each bale as the bale is formed and compacted in the baling chamber.

These and other objects are accomplished by the baling apparatus of the present invention which includes a frame supporting a baling chamber formed by a floor and enclosing sides. Within the baling chamber there are a baling head reciprocal between a retracted position and an advanced position and ram means connected to the baling head for reciprocating the baling head between its two positions. A support member is mounted on the frame behind the retracted position of the baling head, and the baling head has clearance extending through the head. A mandrel anchored at one end in the support member has its other end extending through the clearance in the baling head and extending into the baling chamber. The mandrel forms a longitudinal hole through each bale as the bale is formed. This hole provides ventilation through the bale which tends to prevent the baled organic material from decomposing.

DETAILED DESCRIPTION OF THE PREFERRED EMBODIMENT

Figure 1:
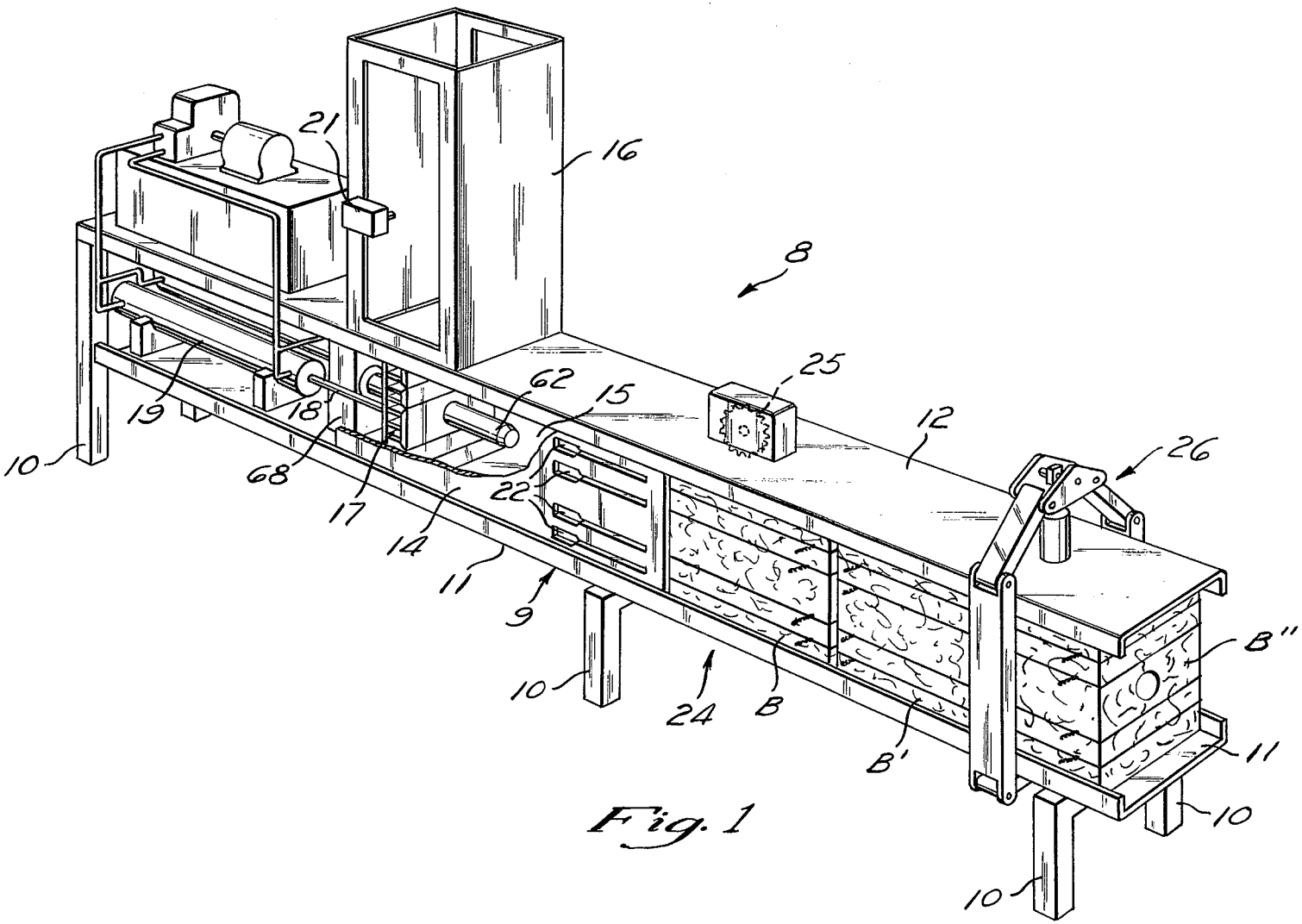
FIG. 1 is a perspective view of a baling machine which includes the apparatus of the present invention.

Referring more particularly to the drawings and initially to FIG. 1, there is shown a baling machine 8 which includes the baling apparatus of the present invention. Baling machine 8 has a support frame 9 which includes a plurality of leg portions 10 and a longitudinally extending floor 11. Extending parallel to and spaced above floor 11 is an upper side 12.

Along a portion of baling machine 8, floor 11 and upper side 12 are connected by enclosing sides 14 to form a baling chamber 15. At the rearward end of baling chamber 15, the top of the baling chamber is open and communicates with a feed hopper 16. Within baling chamber 15, there is a baling head 17 reciprocated by a pair of ram means comprising rods 18, each extending from a hydraulic cylinder 19.

In the normal operation of baling machine 8, the material to be baled, such as bagasse, is deposited in feed hopper 16 with baling head 17 in its retracted position. When the level of the bagasse in baling chamber 15 and feed hopper 16 reaches a predetermined height, this height is sensed by a photocell control unit 21 located on feed hopper 16. The charge of bagasse in baling chamber 15 then is compressed by the reciprocation of baling head 17 into a pad or wafer of compressed material. After a number of charges have been compressed together and a sufficient number of pads or wafers have accumulated to form the desired length for a full bale, baling head 17 is moved to its fully advanced and tying position, and a plurality of wires are inserted manually or automatically (by apparatus not shown in the drawings) through openings 22 in side 14 of baling chamber 15 and through corresponding transverse passages in baling head 17. After these wires have been tied, formation of another bale begins in baling chamber 15, and the finished bale is forced through throat portion 24 of the baling machine, in a manner such as that of bales B and B′ in FIG. 1.

As each bale is being formed in baling chamber 15, the desired length of the bale, as indicated by the movement of the last finished bale B in throat portion 24, is measured by conventional bale length measuring wheel 25. Resistance to the movement of the bales in throat portion 24 is provided by a conventional toggel-like mechanism 26 which acts to constrict the space between floor 11 and upper side 12. This resistance of throat portion 24 to the movement of the bales through it allows the end of the last finished bale B to provide a firm wall against which the bagasse in baling chamber 15 is compacted by baling head 17.

The structure and operation of the above described portions of baling machine 8 are generally conventional and, therefore, will not be described in further detail.

Figure 2:
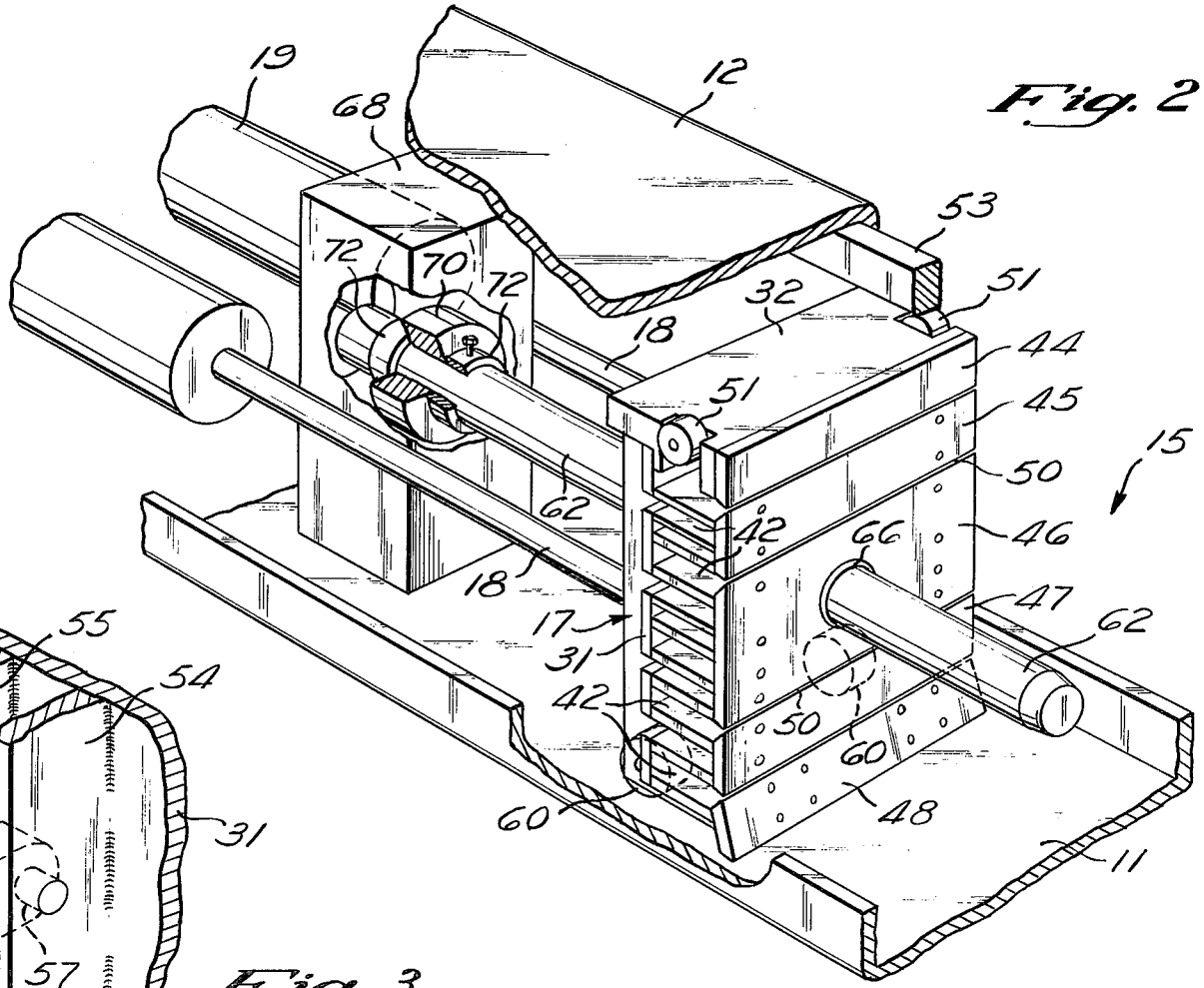
FIG. 2 is another perspective view to a larger scale of the baling chamber including the apparatus of the present invention.
Figure 3:
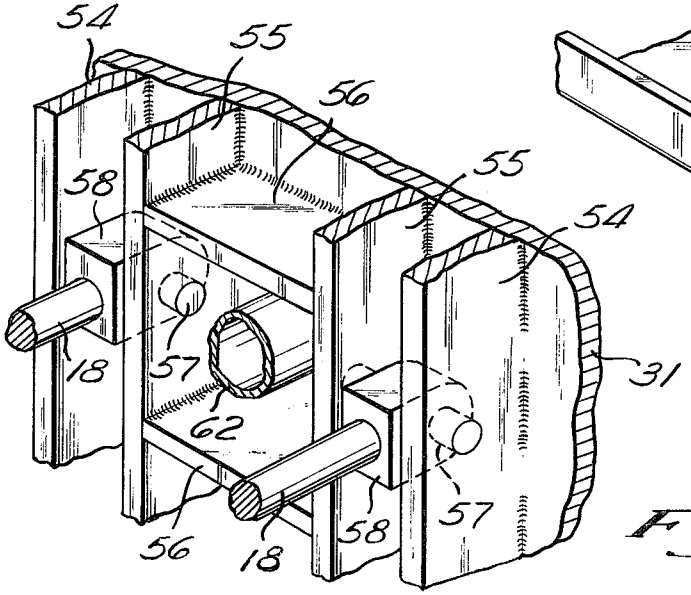
FIG. 3 is a perspective elevation of a portion of the apparatus of FIG. 2 viewed from the rear of the baling head.
Figure 4:
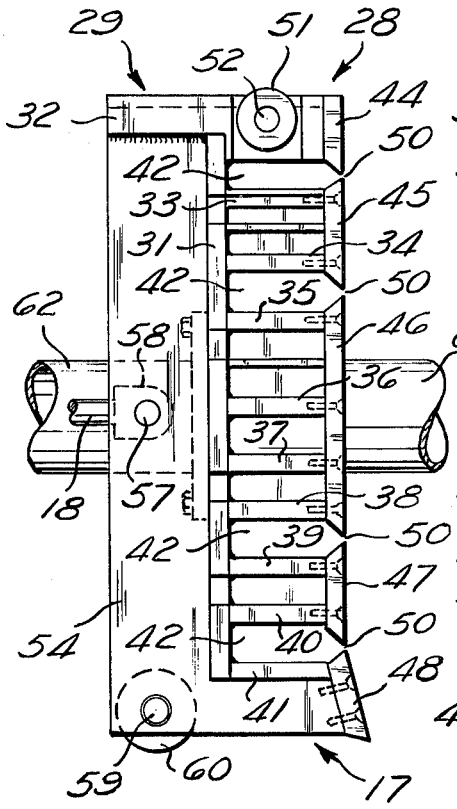
FIG. 4 is a side elevational view of the baling head showing the mandrel extending therethrough.

The baling apparatus of the present invention, including the baling chamber and baling head of FIG. 1, are shown in greater detail in FIGS. 2–6. In FIG. 4, baling head 17 comprises a front portion 28, having a front bale compacting surface and transverse passages for insertion of the tying wires, and a rear portion 29 having attachment means for cylinder rods 18. The two portions are joined along a vertical central plate 31. Across the top of both portions is a top structural member 32.

Figure 5:
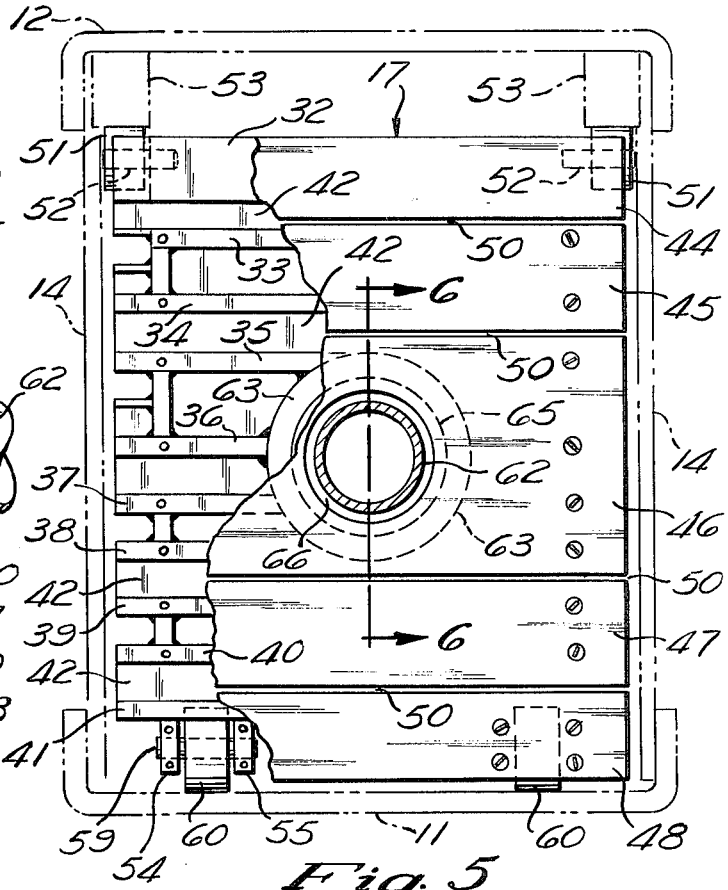
FIG. 5 is a front elevational view of the baling head and mandrel of FIG. 4, with some facing elements thereof broken away.

In front portion 28 of baling head 17, there are a plurality of transverse structural members 33 through 41 extending horizontally forwardly from vertical plate 31 (FIG. 4) and extending horizontally laterally across the baling head (FIG. 5). Various pairs of these members, namely, members 32–33, 34–35, 38–39, and 40–41, form transverse wire threading passages 42. When baling head 17 is in its forwardmost position, passages 42 are aligned with openings 22 in enclosing sides 14 (FIG. 1) and provide passages for the insertion of the wires used for tying the finished bale. At the forward end of members 32 through 41 (FIGS. 2, 4 and 5), the front surface of baling head 17 is covered by front plates 44, 45, 46, 47 and 48 which provide the bale compacting surface. Plates 44, 45, 46, 47 and 48 are separated by narrow wire egress slots 50 which provide for the removal of the wires from passages 42 after the bale has been tied and when baling head 17 retracts.

At the top of front portion 28 of baling head 17, a pair of rollers 51 are mounted to top member 32 on shafts 52. Rollers 51 extend a short distance above the upper surface of the baling head and engage the underside of a rail 53 mounted beneath upperside 12. The engagement of roller 51 against rail 53 assists in the alignment of baling head 17 as it is reciprocated and prevents the baling head from rising off floor 11 of baling chamber 15 as the head is advanced.

Rear portion 29 of baling head 17 comprises parallel vertical members 54 and 55 and horizontal members 56 (FIG. 3). Between each pair of members 54 and 55, there is a mounting pin 57 which is inserted through the forward head 58 of rod 18. At the bottom between each pair of members 54 and 55 is a shaft pin 59 upon which a roller 60 is mounted (FIG. 5). Rollers 60 run along the floor 11 of baling chamber 15 to support and facilitate movement of baling head 17.

At approximately the center of baling head 17, a longitudinal clearance 61 completely through the baling head is provided to accommodate a horizontally extending tubular mandrel 62 which extends through baling head 17 and which extends a substantial distance into baling chamber 15. In this clearance 61 the baling head has an outer tubular member 63 which is attached to vertical plate 31 (FIG. 6) and to the central transverse structural members 35, 36, 37 and 38 (FIG. 5) and which extends forwardly to front plate 46. An inner tubular member or gland 64 (FIG. 6) is mounted within outer member 63 by attachment to vertical plate 31. Members 63 and 64 enclose and capture an inner annular bearing member 65. The tubular interior passages in members 64 and 65 form the clearance 61 in baling head 17 through which mandrel 62 extends. A wiper seal 66 is provided within the opening of front plate 46 at the forward end of bearing member 65 to prevent the baling debris from being carried into the interior passages of members 64 and 65 on the exterior surface of mandrel 62 as baling head 17 is reciprocated back and forth along the mandrel.

Figure 6:
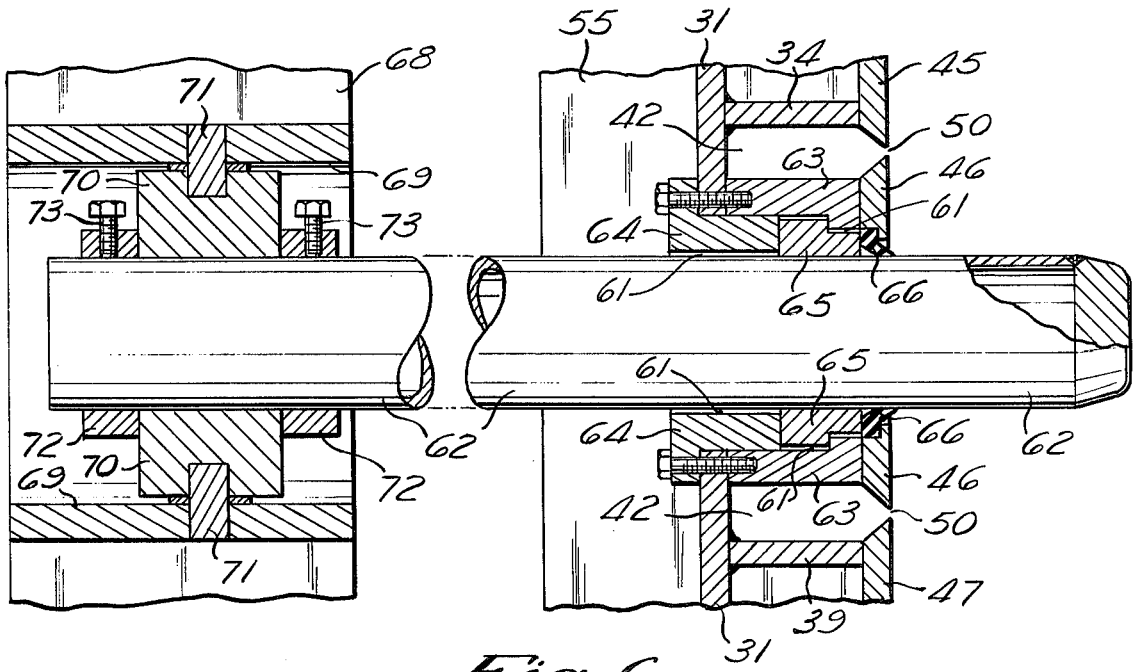
FIG. 6 is a side sectional view of the support column, baling head, and extending mandrel taken along line 6—6 of FIG. 5.

Mandrel 62 is supported both by baling head 17 and by a support column 68 supported on frame 9, and located rearward of baling chamber 15 and the retracted position of baling head 17 (FIGS. 2 and 6). A horizontal bore 69 in support column 68 contains an annular support collar 70 which fits around mandrel 62. Support collar 70 is secured within bore 69 of column 68 by an annular member 71 extending radially into bore 69 and fitting within a corresponding circumferential groove in collar 70. Mandrel 62 is adjustably secured in support collar 70 by a pair of locking rings 72 mounted around mandrel 62 on either side of collar 70. Locking rings 72 are fixed to mandrel 62 by set screws 73. The position of the mandrel with respect to the locking rings can be moved by releasing set screws 73, so that the longitudinal extension of mandrel 62 into baling chamber 15 can be adjusted.

The longitudinal extension of mandrel 62 into baling chamber 15 must be great enough to extend beyond the forward face of baling head 17 in its forwardmost position and into one and preferably at least two of the pads or wafers of compressed material produced by each stroke of baling head 17. One embodiment of a standard-sized baler for bagasse with a baling head have a baling surface of approximately 30 by 37 inches has been operated successfully with the mandrel extending 8 to 10 inches beyond the forwardmost position of travel of the baling head.

In operation of the baler, the forward end of mandrel 62 always is supported by and extends into some compressed material in the baling chamber and serves to maintain a ventilating passage in at least the most recently compressed material in the chamber. Also, of course, mandrel 62 forms the continuation of the ventilating passage in each new pad of material as it is compressed around it in the baling chamber by the stroke of baling head 17.

It can be seen that the baling apparatus of this invention differs from conventional apparatus by providing a pair of rods 18 and cylinders 19, one on each side of support column 68, instead of the single rod and cylinder of the prior art. It will be apparent that the pair of cylinders 19 could also be effective if mounted vertically above and below each other as well as side by side. Also, to accommodate the mandrel 62 and the resulting hole in each bale, the tying wire around the central portion of the bale, which is common with bales formed by conventional balers of the prior art, is omitted to provide for formation of the central ventilation hole in the bale.

The present invention has been described with respect to a specific embodiment thereof, and it would be obvious to those skilled in the art to which this invention pertains that various modifications and changes of this preferred embodiment may be made without departing from the spirit and scope of this invention and defined by the following claims.

What is claimed is:

1. A baling apparatus for baling bagasse or other material in which a longitudinal hole is formed through the bale, said apparatus comprising:

a longitudinally horizontally extending frame including a horizontal floor and fixed vertical enclosing sides extending perpendicularly thereto which form a baling chamber having a rectangular cross section;

a baling head longitudinally reciprocal within said chamber between a retracted position and an advanced position, each reciprocation capable of forming one pad of the bale, said baling head having longitudinally extending clearance through said head with an annular bearing member within said clearance, said baling head having rollers which engage portions of said frame for facilitating the reciprocable movement of said head;

a pair of ram means, each ram means comprising a sealed cylinder mounted on said frame behind the retracted position of said baling head and an operative rod extending from said cylinder and connected to said baling head for reciprocating the head between its retracted and advanced positions;

a support column mounted on said frame between the extending rods of said pair of ram means and in front of the cylinders of said pair of ram means and behind the retracted position of said baling head;

a horizontally extending tubular mandrel adjustably anchored at one end in said support column with the other end extending through said clearance in said baling head and through said annular bearing member and through at least one pad of the bale when said baling head is in its fully advanced position, said clearance accommodating lateral adjustments in the longitudinal alignment of said mandrel between said supported column and the baled material, said baling head capable of slidably moving along said mandrel as it reciprocates, the rods of said pair of ram means extending generally parallel to said mandrel and spaced laterally on either side of it; and a wiper seal with said clearance in said baling head surrounding said mandrel for wiping said mandrel clean and for preventing pieces of baled material from passing through said clearance as said head reciprocates.

* * * * *